United States Patent [19]

Gardner

[11] 4,344,569

[45] * Aug. 17, 1982

[54] STEAM POWERED STOVE

[76] Inventor: James J. Gardner, 210 Sherman Ave., Lancaster, Ohio 43130

[ * ] Notice: The portion of the term of this patent subsequent to Jul. 22, 1997, has been disclaimed.

[21] Appl. No.: 112,735

[22] Filed: Jan. 17, 1980

[51] Int. Cl.[3] ..... B60H 1/02; F24D 1/04; F24D 5/00

[52] U.S. Cl. ..... 237/12.1; 237/52; 126/101; 60/643

[58] Field of Search ..... 237/12.1, 52, 67, 9 R; 126/101, 132, 130; 60/643, 645, 669, 670, 721; 236/38

[56] References Cited

U.S. PATENT DOCUMENTS 33,497 10/1861 Shaw ..... 237/12.1

884,610 4/1908 Rateau ..... 237/12.1

4,213,444 7/1980 Gardner ..... 126/130

*Primary Examiner*—Albert J. Makay

*Assistant Examiner*—Henry Bennett

[57] ABSTRACT

A "Steam Powered Stove" which burns any suitable fireplace fuel in a standard stove firebox. Directly above the firebox is a water boiler tank. This tank has tube penetration extending into the firebox for increased steam generation efficiency. Steam pressure is directed to a regulator which can readily be adjusted to the desired pressure by turning a long stem handwheel. Steam pressure strikes the blades of a turbine causing fans to rotate. Cold air is drawn by the fans through a heater box and then into the atmosphere. A removable pulley can be attached for driving other equipment. Water level is maintained by an inherent water fill tank. Used steam is exhausted up the vent pipe.

1 Claim, 4 Drawing Figures

STEAM POWERED STOVE

CROSS REFERENCE TO RELATED APPLICATION

This application is a further development and an additional application of the principles set forth under Ser. No. 895,233 filed Apr. 10, 1978 now U.S. Pat. No. 4,213,444.

BACKGROUND AND SUMMARY OF THE INVENTION

The invention relates to a means of heating an area by a steam powered stove. In the past, stoves and fireplaces have been equipped with electric blowers which add a great deal to the heating capacity. Over the last several winters, it has become evident that electricity is not a reliable source of energy in heavy storms and blizzards. According to the teachings of the present invention, steam power can be readily and efficiently utilized to blow hot air and to provide supplemental electricity to the American household.

According to the heating system of this present invention, a boiler tank is located directly above the firebox. This tank has tube penetrations extending into the firebox for increased steam generation efficiency. Steam pressure build up is controlled by a pressure regulator. When steam is released from the regulator, it is directed through a nozzle to a turbine. Steam pressure strikes the turbine blades causing torque to be transmitted to blowers located on both sides of the stove. The water level is maintained by an inherent water fill tank connected to a household water system. Used steam is exhausted up the vent pipe. A removable pulley may be attached to the shaft for driving other equipment, and a safety valve is installed for safe household use.

DETAILED DESCRIPTION

Figure 2:
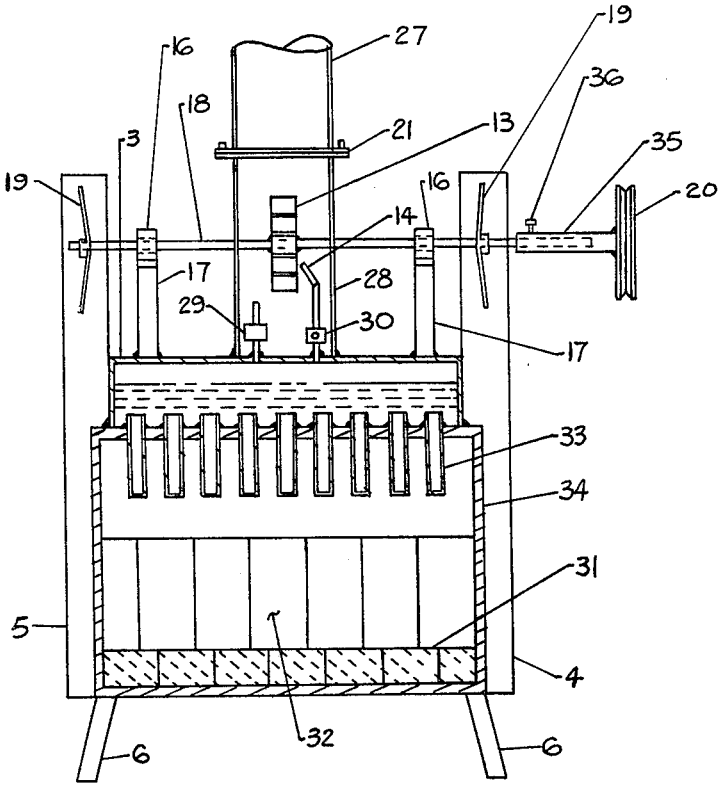
FIG. 2 is a cross-sectional view taken parallel to the shaft and looking toward the rear of the stove.

FIG. 2 shows a cross section of a steam powered stove. Firebox 34 is preferably made from cast steel and lined with firebrick 31 in the lower portion thereof and firebrick 32 in the rear portion thereof. The firebox 34 is to have a plurality of holes drilled in the upper horizontal wall for tubes 33. The tubes being open at the top portion and sealed at the bottom portion thereof. Tubes 33 should be extended sufficiently above the firebox to facilitate welding. Tubes 33 should be welded watertight.

A water boiler tank 3 made from bent plate is welded watertight to the top of the firebox at the left and right hand sides thereof. Two holes are drilled in the upper horizontal wall for safety valve 29 and pressure regulator 30 penetrations.

The front wall 1 (FIG. 1) is made from cast steel having a rectangular opening cast therein for the door 8. The front wall 1 is welded watertight to the boiler tank 3 and firebox 34. The front wall 1 has a conventional hinge 9 attached thereto.

Figure 4:
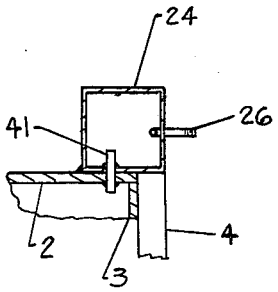
FIG. 4 is a cross-sectional view of the water fill tank taken along lines 4—4.

The rear wall 2 (FIG. 1) is made from cast steel having an opening therein for vent pipe 23 and water fill pipe 41 (FIG. 4). Rear wall 2 is welded watertight to boiler tank 3 and firebox 34.

The door 8 has a conventional vent 10 with and adjusting screw 11 whereby combustion air may be regulated. A conventional latch 12 secures the door.

The pressure regulator 30 (FIG. 2) is equipped with a hand wheel 15 (FIG. 1) for adjusting steam pressure. The user for example may want to minimize combustion thus creating lower steam pressure. This lower steam pressure may not be adequate for driving other equipment but may supply enough energy for turning the blowers. Attached to the pressure regulator is the nozzle 14 which directs steam pressure to the turbine 13. The turbine is mounted on a shaft 18. Said shaft is supported by conventional bearings 16 and support blocks 17. Mounted on the left and right hand sides of the shaft 18 are two fans 19 designed to blow hot air from the sheet metal heater boxes 4 and 5. At the lower portion of the heater boxes are screened cold air openings 7. A removable pulley 20 is attached to the right hand side of the shaft 18 using bolt 36 (FIG. 2) which threads into shaft 18. Sleeve 35 is a slip-fit over shaft 18.

The steam exhaust vent pipe 28 is welded watertight to the top of the boiler tank 3 and completely encloses the pressure regulator and safety valve. Flange 21 is an assembly feature. Elbow 27 and pipe 22 direct used steam into 23 which is the combustion gas vent pipe.

Figure 1:
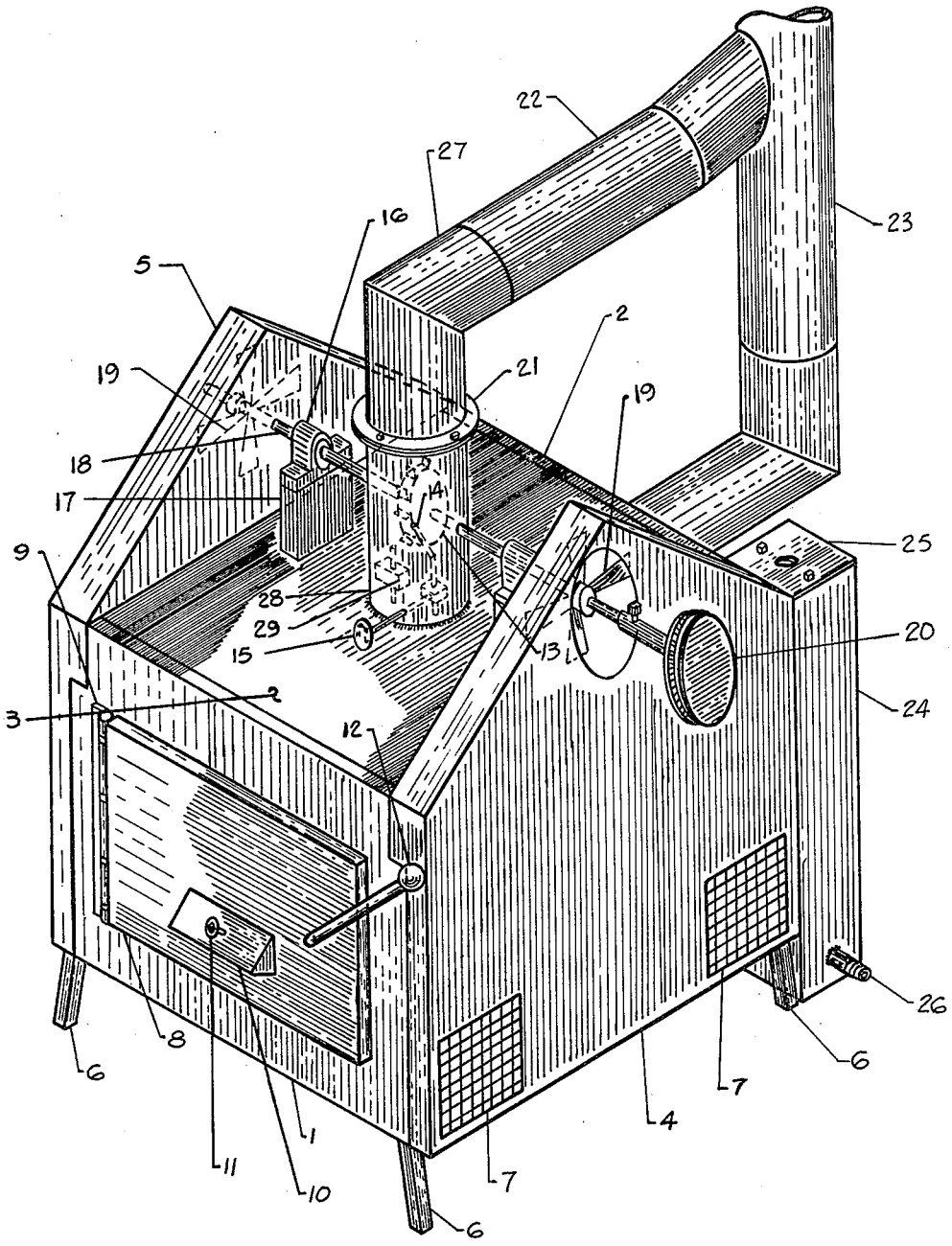
FIG. 1 is an arrangement view showing basic features of the invention.
Figure 3:
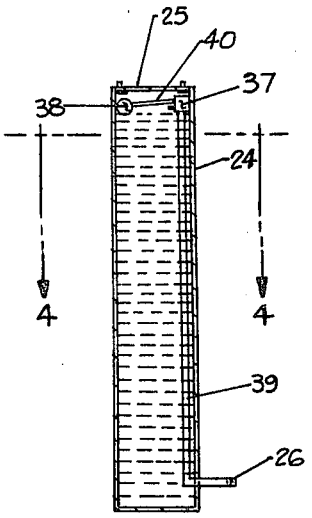
FIG. 3 is a cross-sectional view taken through the water fill tank and looking toward the rear of the stove.

The inherent water fill system is shown in FIG. 1, FIG. 3 and FIG. 4. 24 is a watertight tank having 26 a threaded pipe nipple welded thereto. 26 is to be connected to the household water system. Water flow is transmitted to a conventional float valve 37 by pipe 39. 40 is the stem and 38 is the float. When the water level recedes, the float will activate the valve thus maintaining constant water level. 25 is a removable lid with a hole provided therein for steam escape. It may chance that a small amount of steam would be generated by the heat from the stove. Hole in lid 25 is a safety feature. Water fill pipe 41 (FIG. 4) provides water flow communication from the fill tank 24 to boiler tank 3 and is welded watertight.

Steel legs 6 are welded to the firebox at four corners for support.

What I claim is:

1. A Steam Powered Stove comprising:

A. a stove means having a liquid containing portion therein, a means for feeding said liquid containing portion, a means of exhausting steam, and a steam pressure safety valve means, B. a steam pressure regulator means having a long stemmed hand wheel thereon whereby steam pressure may be conveniently adjusted and set at various pressures, said regulator means further consisting of a nozzle attached thereto whereby steam pressure may be directed to a turbine, C. a turbine means having a body with a plurality of blades extending therefrom said body being centered about a shaft such that said turbine blades are equidistant from said shaft's centerline said body being securely mounted on said shaft and generally centered thereon whereby torque may be transmitted to a plurality of fan means positioned on said shaft, said shaft being supported from a plurality of support blocks having bearings mounted thereon said fan means being securely mounted on said shaft and are positioned and designed to blow hot air from heater boxes, D. a plurality of heater boxes positioned adjacent to the firebox and liquid containing portion of said stove means and in thermal communication therewith whereby the heat of conduction, convection, and radiation may be transferred therethrough, said heater boxes having a plurality of secreened cold air openings near the bottom portions thereof and hot air discharge openings near the upper portions thereof, said hot air discharge openings being in alignment with said fan means, said heater boxes rising to a vertex at the approximated centerline and above said shaft, E. and a removable torque transfer means or pulley whereby other equipment may be driven by said stove means, said torque transfer means being securely mounted to said shaft in such a manner that it may be conveniently removed and replaced.

* * * * *